US009903684B2

(12) United States Patent
Lort

(10) Patent No.: US 9,903,684 B2
(45) Date of Patent: Feb. 27, 2018

(54) HIGH PRESSURE AIR SYSTEM FOR AIRSOFT GUN

(71) Applicant: Wolverine Airsoft, LLC, Kingsport, TN (US)

(72) Inventor: Rich Lort, Kingsport, TN (US)

(73) Assignee: Wolverine Airsoft, LLC, Kingsport, TN (US)

( * ) Notice: Subject to any disclaimer, the term of this patent is extended or adjusted under 35 U.S.C. 154(b) by 0 days.

(21) Appl. No.: 14/791,851

(22) Filed: Jul. 6, 2015

(65) Prior Publication Data

US 2016/0033230 A1 Feb. 4, 2016

Related U.S. Application Data

(60) Provisional application No. 62/020,458, filed on Jul. 3, 2014, provisional application No. 62/048,590, filed on Sep. 10, 2014.

(51) Int. Cl.
*F41B 11/00* (2013.01)
*F41B 11/723* (2013.01)

(52) U.S. Cl.
CPC ..... *F41B 11/723* (2013.01)

(58) Field of Classification Search
CPC ..... F41B 11/72; F41B 11/73; F41B 11/721; F41B 11/723; F41B 11/62; F41B 11/57; F41B 11/71
USPC ..... 124/73–77
See application file for complete search history.

(56) References Cited

U.S. PATENT DOCUMENTS 4,770,153 A * 9/1988 Edelman ..... F41B 11/51 124/72
5,613,483 A * 3/1997 Lukas ..... F41B 11/724 124/70
5,778,868 A * 7/1998 Shepherd ..... F41B 11/723 124/73
6,601,780 B1 * 8/2003 Sheng ..... F41B 11/52 124/51.1
6,925,997 B2 * 8/2005 Sheng ..... F41B 11/52 124/56
7,121,273 B2 * 10/2006 Styles ..... F41A 7/08 124/77
7,299,796 B2 * 11/2007 Kirwan ..... F41B 11/721 124/71
7,509,953 B2 * 3/2009 Wood ..... F41B 11/68 124/73
7,533,664 B2 * 5/2009 Carnall ..... F41B 11/721 124/77
7,603,997 B2 * 10/2009 Hensel ..... F41B 11/52 124/77
7,712,464 B2 * 5/2010 Lian ..... F41B 11/721 124/70
7,730,881 B1 * 6/2010 Pedicini ..... F04B 9/02 124/65

(Continued)

*Primary Examiner* — Michael David
(74) *Attorney, Agent, or Firm* — Pitts & Lake, P.C.

(57) ABSTRACT

A high pressure air cylinder to use in an airsoft gun or similar devices and systems. In some embodiments, the present general inventive concept encompasses a cylinder in which an imbalanced poppet valve directs and controls the axial motion of a piston. Some embodiments include a two-way solenoid valve. Some embodiments include a precisely sit two-way solenoid valve. The solenoid valve controls the flow of air to drive a piston forward; air then pushes the piston back into place.

10 Claims, 6 Drawing Sheets

(56) References Cited

U.S. PATENT DOCUMENTS 7,735,479 B1 * 6/2010 Quinn ..... F41B 11/62 124/60
7,762,247 B2 * 7/2010 Evans ..... F41B 11/62 124/31
7,770,572 B2 * 8/2010 Lian ..... F41B 11/723 124/73
7,861,703 B2 * 1/2011 Liao ..... F41B 11/721 124/77
7,931,018 B1 * 4/2011 Lai ..... F41B 11/721 124/71
7,997,260 B2 * 8/2011 Kaakkola ..... F41B 11/721 124/71
8,033,276 B1 * 10/2011 Gabrel ..... F41B 11/723 124/73
8,104,463 B2 * 1/2012 Wood ..... F41B 11/721 124/73
8,336,532 B2 * 12/2012 Masse ..... F41B 11/57 124/75
8,453,633 B2 * 6/2013 Tsai ..... F41B 11/643 124/66
8,485,172 B2 * 7/2013 Tseng ..... F41B 11/721 124/73
8,671,928 B2 * 3/2014 Hague ..... F41B 11/721 124/73
9,033,306 B2 * 5/2015 Kunau ..... B60C 25/145 141/38
9,080,832 B2 * 7/2015 Brahler, II ..... F41B 11/723
9,297,606 B2 * 3/2016 Harvey ..... F41C 23/22
2002/0096164 A1 * 7/2002 Perrone ..... F41B 11/52 124/77
2003/0005918 A1 * 1/2003 Jones ..... F41B 11/57 124/70
2004/0200115 A1 * 10/2004 Monks ..... F41A 19/10 42/84
2007/0119988 A1 * 5/2007 Sheng ..... F41B 11/721 239/525
2008/0127960 A1 * 6/2008 Gan ..... F41B 11/62 124/75
2012/0216786 A1 * 8/2012 Hadley ..... F41B 11/51 124/66
2013/0247893 A1 * 9/2013 Yang ..... F41B 11/55 124/74

* cited by examiner

HIGH PRESSURE AIR SYSTEM FOR AIRSOFT GUN

CROSS-REFERENCE TO RELATED APPLICATIONS

This Application claims the benefit of U.S. Provisional Patent Application Ser. No. 62/020,458, filed Jul. 3, 2014, and of U.S. Provisional Patent Application Ser. No. 62/048,590, filed Sep. 10, 2014. The content of both foregoing applications is incorporated herein by reference.

STATEMENT REGARDING FEDERALLY SPONSORED RESEARCH OR DEVELOPMENT

Not Applicable

BACKGROUND OF THE INVENTION

1. Field of Invention

The present invention pertains generally to airsoft guns and, more particularly, to a high pressure fluid mechanisms to be used in airsoft guns.

2. Description of the Related Art

Airsoft guns employ compressed air fire round plastic pellets or similar projectiles, usually ranging from 0.12 g to 0.48 g. Airsoft players often fire airsoft guns at other players during airsoft games and competitions.

Various "firing" mechanisms are known in the art for airsoft guns. For instance, U.S. Pat. No. 7,527,049, issued to Sheng, discloses a pneumatic pusher having a main body, a flow-guiding body, a moving body, and a delivery tube. The flow-guiding body includes a front tube with a smaller diameter and a rear tube with a larger diameter. The delivery tube is mounted on the front tube in such a way that the outer wall of the delivery tube and the inner wall of the main body define a return pressure chamber. A first gas-distributing channel extending from a first air outlet at one side of the main body leads directly to the inner side of the delivery tube. The side of the first air inlet of the main body communicates with a second gas-distributing channel. The second gas-distributing channel includes an exit located at one side of the return pressure chamber of the delivery tube. The air pressure provided through the second gas-distributing channel serves as cushioning force in pushing the delivery tube outwardly.

U.S. Pat. No. 8,453,633, issued to Tsai, discloses a spring-piston airsoft gun that includes a cylinder-and-piston assembly disposed in a barrel to force air through a muzzle end to make a shooting action, and a coil spring disposed to exert a biasing action to drive a piston head of the cylinder-and-piston assembly when changed from a compressed state to a released state. Front and rear anchor shanks are disposed for respectively mounting front and rear coil segments of the coil spring. A major shell and a minor ring are sleeved on the rear anchor shank to permit the coil spring to be sleeved thereon. The minor ring is in frictional contact with and angularly moveable relative to the major shell such that, when the coil spring is released to expand to the released state, the rear coil segment is tensed to drag the minor ring to angularly move therewith so as to minimize the frictional force therebetween.

U.S. Pat. No. 8,671,928, issued to Hague et al. and assigned to Polarstar Engineering & Machine, discloses a pneumatic assembly for a projectile launching system includes a body defining a continuous bore. A nozzle is positioned within the bore adjacent a forward end and is moveable between a rearward position wherein the nozzle facilitates passage of a projectile through a projectile port and a forward position wherein the nozzle prevents passage of a projectile through the projectile port. The nozzle is biased to the forward position and configured for fluid actuation to the rearward position by activation of a first fluid control valve. A valve seat defines an accumulation chamber rearward of the nozzle. A firing valve member is moveable between a forward position wherein the firing valve member fluidly seals a passage through the valve seat and a rearward position wherein the passage is fluidly opened such that fluid in the accumulation chamber is free to flow through the passage and out of the nozzle. Example embodiments of this pneumatic assembly generally include a nozzle spring contained between the rear surface of the nozzle and the front surface of a center cylinder.

U.S. Patent Application Publication Number 2012/0216786, by Hadley and Calvin, teaches a soft impact projectile launcher including a launching mechanism that creates a burst of air or air pressure in order to launch a projectile. The launching mechanism includes an outer cylinder and a spring-loaded piston configured to generate the burst of air. The projectile launcher may also include a projectile reservoir and a loading member that positions projectiles for launching. The projectile launcher can launch projectiles that are made from a superabsorbent polymer and consist of mostly water.

U.S. Patent Application Publication Number 2013/0247893, by Yang, teaches an airsoft gun structure designed to shunt high-pressure air flow during shooting. Therefore, the shunted high-pressure air flow simulates recoils as real bolt-action, single-shot rifles. Also, the ammunition supply includes different cartridges to select one of the supply-type by the users and whether shell case ejection or not. When operates the airsoft gun, the realistic action is achieved to enhance the fun of shooting. Furthermore, the dual hop up system makes the flight path of bullets more stable without shift. Moreover, the safety gasification system could make the supplied amount of the output compressed high pressure air be almost constant to enhance security during operation. The devices disclosed in Yang include a hammer block spring or magazine spring attached to an inner surface of the back block in an inner barrel.

BRIEF SUMMARY OF THE INVENTION

The present general inventive concept, in some of its many embodiments, encompasses a springless high pressure air cylinder to use in an airsoft gun or similar devices and systems. In some embodiments, the present general inventive concept encompasses a cylinder in which an imbalanced poppet valve directs and controls the axial motion of a piston. Some embodiments include a two-way solenoid valve. The solenoid valve controls the flow of air to drive a piston forward; air then pushes the piston back into place.

In some embodiments of the present general inventive concept, a springless high pressure air cylinder for use in an airsoft gun includes a cylinder frame body, a piston having a nozzle member and a piston base member, the piston base member moving within the cylinder frame body along an axis, the piston base member including a first piston head surface and a second piston head surface, the piston being capable of moving between a forward position and a back position, a solenoid valve to direct air to the piston base member, whereby air pressure on the first piston head surface moves the piston from the back position to the forward position, and an auxiliary line to direct air against the second piston head surface, whereby air pressure on the second piston head surface moves the piston from the forward position to the back position.

In some embodiments, the auxiliary line is a part of the cylinder frame body. In some embodiments, the auxiliary line is separate from the cylinder frame body.

In some embodiments, the solenoid valve is a two-way solenoid valve.

Some embodiments further encompass a baffle member interposed between said piston base member and said cylinder frame body.

In some embodiments of the present general inventive concept, a high pressure air cylinder-nozzle assembly includes a cylinder frame body, a piston having a nozzle member and a piston base member, the piston base member moving within the cylinder frame body, the piston being capable of moving between a forward position and a back position, the piston base member including a primary piston head surface and a secondary piston head surface, a solenoid valve to direct air to the piston base member at a location proximate the primary piston head surface, air pressure on the primary piston head surface moving the piston from the back position to the forward position, and a secondary air line to direct air against the secondary piston head surface, air pressure on the secondary piston head surface moving the piston from the forward position to the back position.

Certain embodiments are further characterized in that the high pressure air cylinder-nozzle assembly is used in an airsoft gun.

Certain embodiments are further characterized by a spring positioned within the cylinder frame body to assist in moving the piston from the forward position to the back position.

Certain embodiments are further characterized by a spring positioned within the cylinder frame body to assist in moving the piston from the back position to the forward position.

Certain embodiments are further characterized in that the secondary air line is a part of the cylinder frame body.

Certain embodiments are further characterized in that the solenoid valve is a two-way solenoid valve.

Some embodiments further encompass a baffle member interposed between said piston base member and said cylinder frame body.

Certain embodiments are further characterized in that said baffle member includes air slits air slits permitting passage of air from said secondary air line to said secondary piston head surface when said piston from is in the forward position.

Certain embodiments are further characterized in that the primary piston head surface and the secondary piston head surface are opposing surfaces of one piston member.

In some embodiments of the present general inventive concept, a high pressure cylinder for use in a gun includes a cylinder frame body, a piston having a nozzle member and a piston base member, the piston base member moving within the cylinder frame body along an axis, the piston base member including a first piston head surface and a second piston head surface, the piston being capable of moving between a forward position and a back position, a solenoid valve to direct a fluid to the piston base member, whereby fluid pressure on the first piston head surface moves the piston from the back position to the forward position, and an auxiliary fluid line to direct fluid against the second piston head surface, whereby fluid pressure on the second piston head surface moves the piston from the forward position to the back position.

In some embodiments, the auxiliary line is a part of the cylinder frame body.

In some embodiments, the solenoid valve is a two-way solenoid valve.

Some embodiments further encompass a baffle member interposed between said piston base member and said cylinder frame body.

In some embodiments, said baffle member includes air slits permitting passage of air from said secondary air line to said secondary piston head surface when said piston from is in the forward position.

In some embodiments, said primary piston head surface and said secondary piston head surface are opposing surfaces of one piston member.

BRIEF DESCRIPTION OF THE DRAWINGS

The above-mentioned and additional features of the invention will become more clearly understood from the following detailed description of the invention read together with the drawings in which.

DETAILED DESCRIPTION OF THE INVENTION

Disclosed herein are various example embodiments of a springless high pressure air cylinder to use in an airsoft gun or similar devices and systems. In some embodiments, the present general inventive concept encompasses a cylinder in which an imbalanced poppet valve directs and controls the axial motion of a piston. Some embodiments include a two-way solenoid valve. The solenoid valve controls the flow of air to drive a piston forward; air then pushes the piston back into place.

Figure 1:
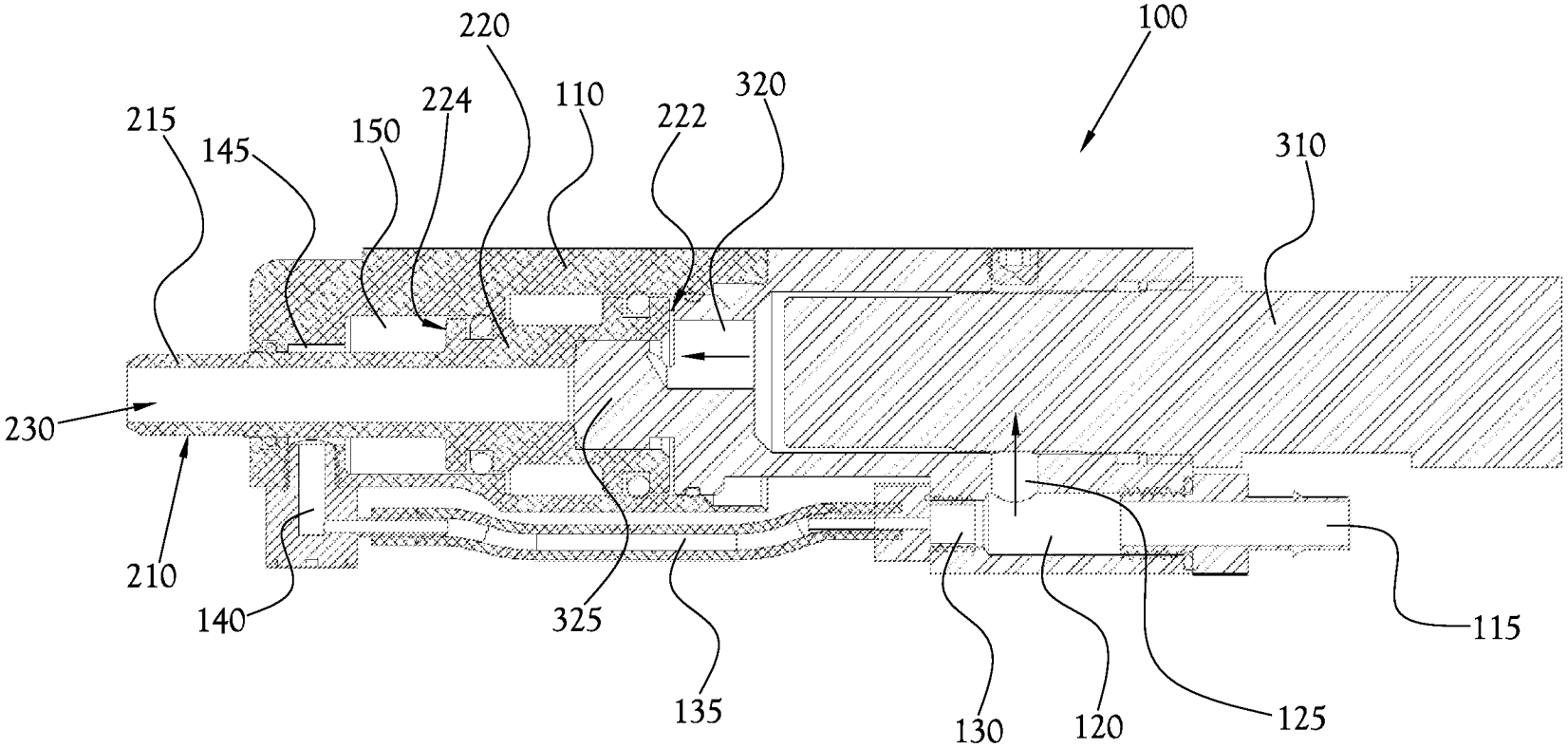
FIG. 1 is a section view of a cylinder-nozzle assembly according to one example embodiment of the present general inventive concept, showing the piston and nozzle in the "back" position.

Turning to the figures, FIG. 1 shows a cross-section view of one example embodiment of a cylinder-nozzle assembly according to the present general inventive concept. In FIG. 1, the cylinder-nozzle assembly 100 includes a cylinder frame body 110, a piston 210, and a solenoid 310. A substantial portion of the piston 210 fits within the cylinder frame body 110 and moves within the cylinder frame body 110. The piston 210 includes a nozzle 215 (which defines the central air channel 230) and a piston head portion 220.

FIG. 1 shows the cylinder-nozzle assembly 100 with the piston 210 in a "back" or rest position. In the back position, the piston head portion 220 and part of the nozzle 215 fit within an interior volume 150 defined by the surrounding cylinder frame body 110, and the piston head portion 220 of the piston 210 fits closely (but generally not in an air-tight fit) against and partially wraps around a central head member 325. To move the piston 210, high pressure air enters the assembly through an air input channel 115, which feeds to a HPA compartment 120. From the HPA compartment 120, air passes through a solenoid input channel 125 into the solenoid 310. Within the solenoid 310 is a valve, which is capable of switching between a closed state and an open state. When a trigger mechanism of the airsoft gun activates the solenoid 310, the valve within the solenoid 310 switches into its open state, allowing the passage of air from the input channel through the solenoid 310 and into an antepiston compartment 320 defined by the cylinder frame body 110 and proximate to the piston head portion 220 of the piston 210.

Figure 2:
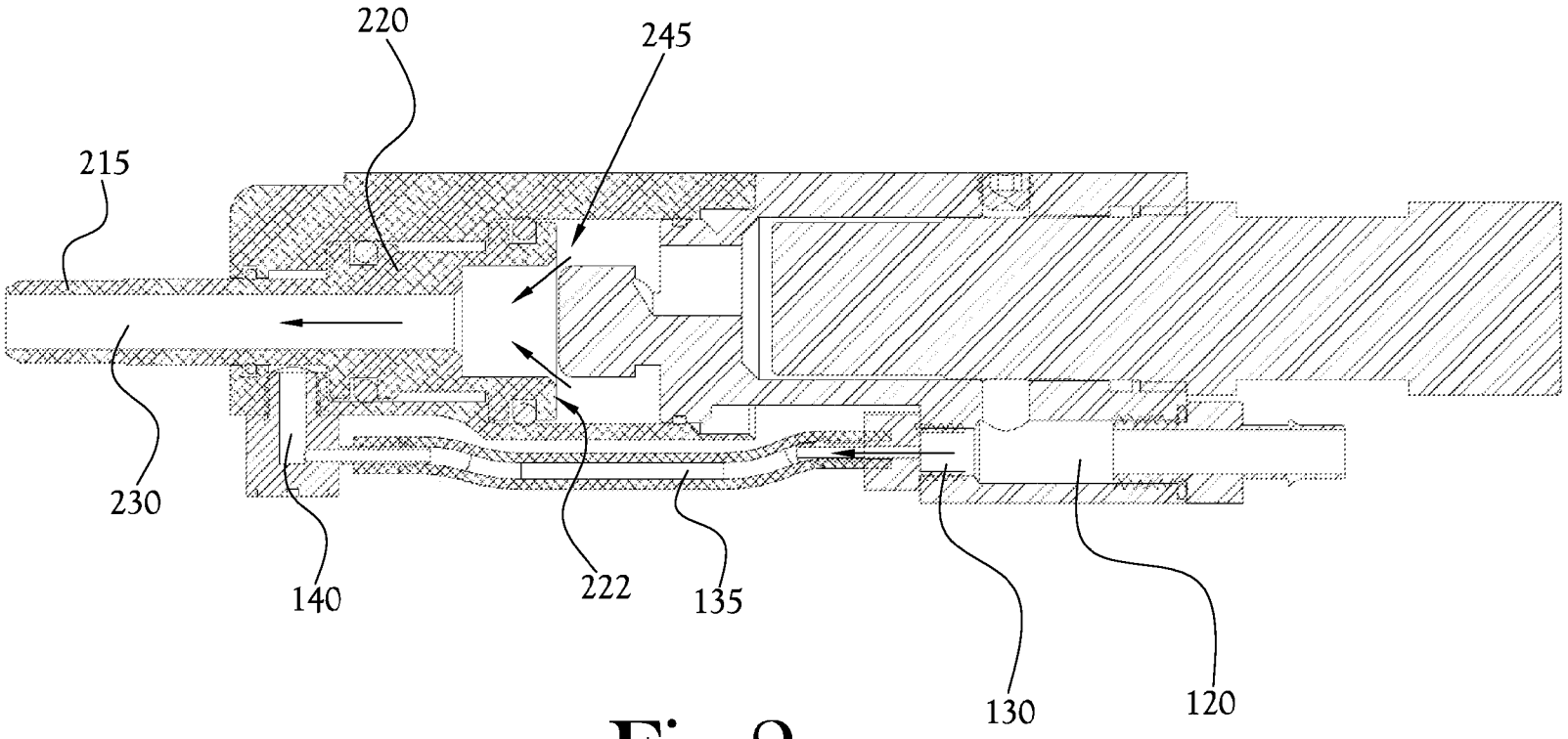
FIG. 2 is a second section view of the example embodiment cylinder-nozzle assembly shown in FIG. 1, showing piston and nozzle in the "forward" position.
Figure 3:
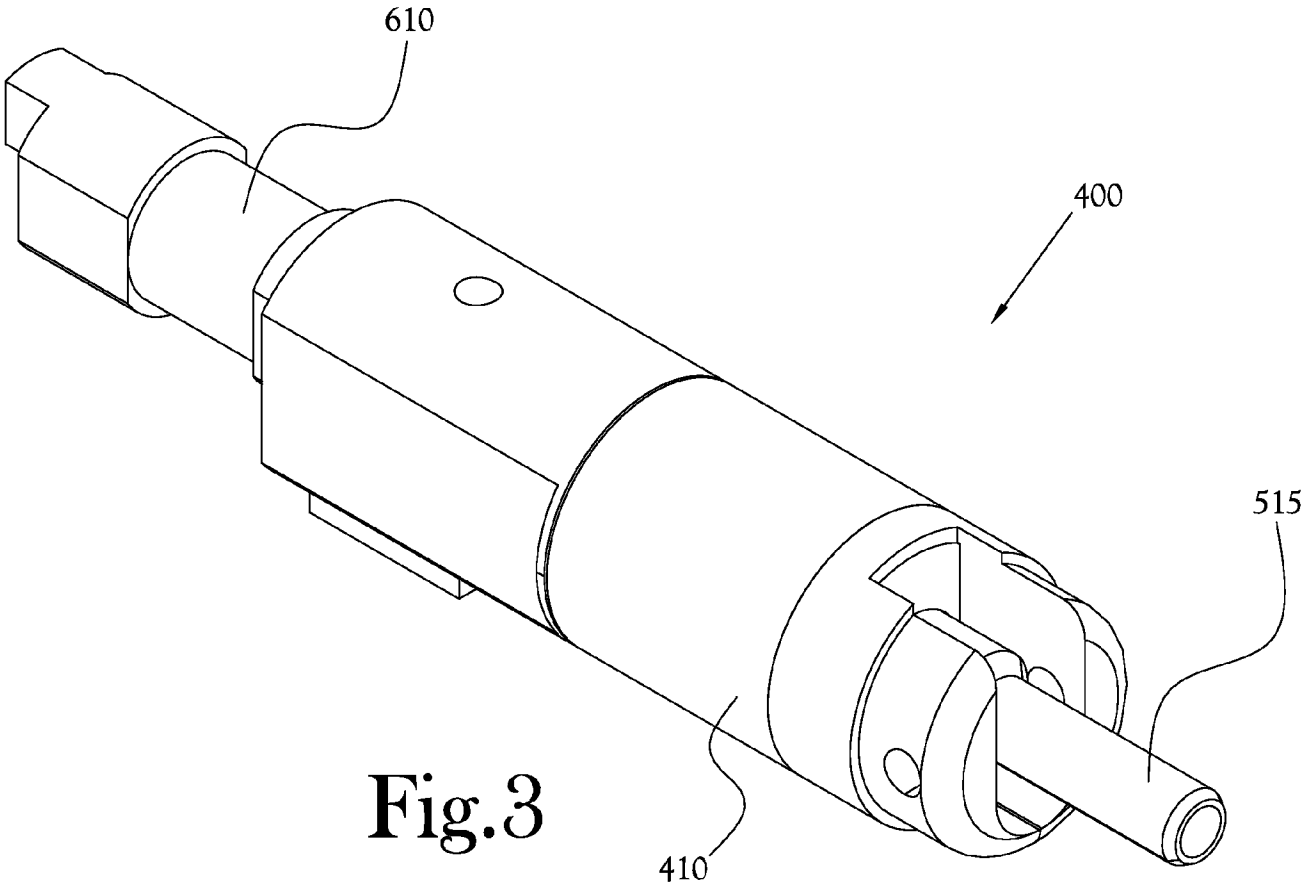
FIG. 3 is a perspective view of a cylinder-nozzle assembly according to one example embodiment of the present general inventive concept.
Figure 4:
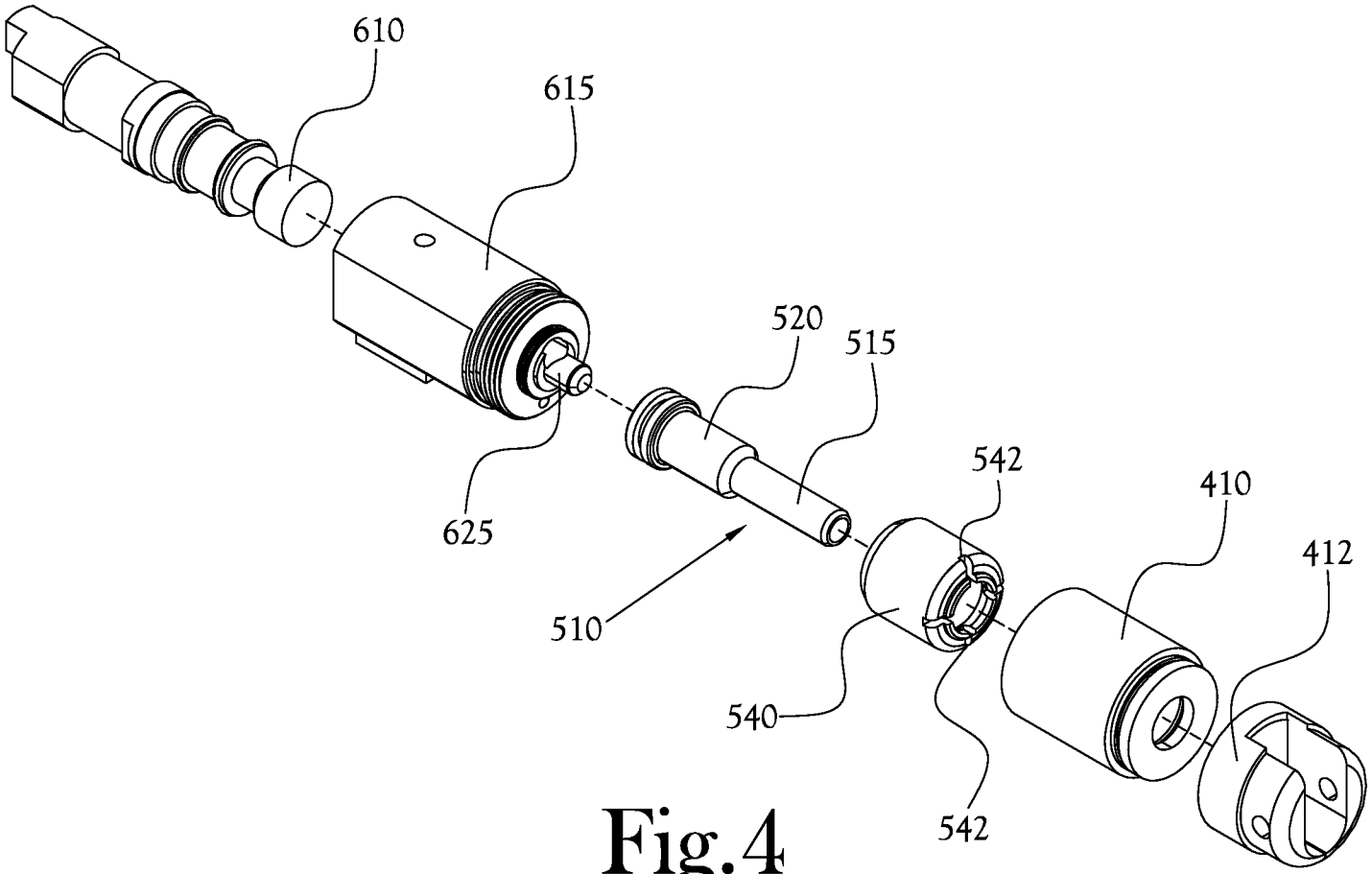
FIG. 4 is an exploded view of the example embodiment shown in FIG. 3.
Figure 5:
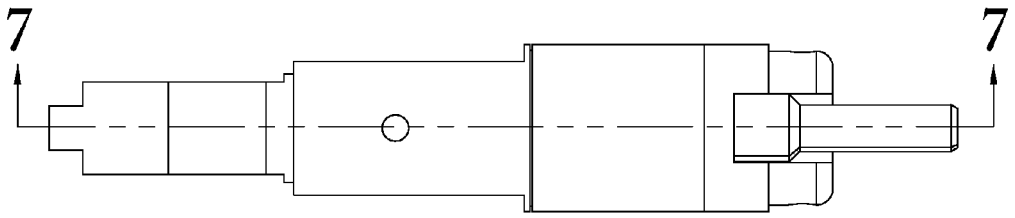
FIG. 5 is a top-down view of the example embodiment shown in FIGS. 3 and 4, showing the section-line along which is taken the views of FIGS. 6 and 7.

As air flows into the antepiston compartment 320, the air pushes on a primary piston head surface 222. Air pressure on the primary piston head surface 222 pushes the piston 210 forward within the cylinder frame body 110, until the piston 210 is in a "forward" position, illustrated in FIG. 2. Once the piston 210 is in the forward position, air from the solenoid 310 passed into the antepiston compartment 320 is free to travel through the open space 245 between the piston head portion 220 and the central head member 325; from there the air passes through the central air channel 230 defined by the nozzle 215.

With the piston 215 in the forward position, the valve within the solenoid 310 closes, and high pressure air being fed into the HPA compartment 120, instead of flowing through the solenoid 310, flows through an auxiliary tube 130 and auxiliary line 135 into a forward air feed tube, which feeds the air into a forward air compartment 145 within the cylinder frame body 110. The air in the forward air compartment 145 exerts pressure on a secondary piston head surface 224, and that pressure drives the piston 210 to return to the back position shown in FIG. 1.

In some embodiments of the present general inventive concept, the two piston surfaces are opposite sides of the same piston, with the center diameter of the two sides differing—thereby leading to a difference in the surface area of the two piston surfaces.

Some further example embodiments of the present general inventive concept include assemblies in which a spring positioned within the cylinder frame body assists in returning the piston to the back position. This spring, then, supplements the motive force of the air supplied by the auxiliary line. Some further example embodiments of the present general inventive concept include assemblies in which a spring positioned within the cylinder frame body assists in returning the piston to the forward position. This spring, then, supplements the motive force of the air supplied by the auxiliary line In some embodiments, the cylinder-nozzle assembly is designed to fit into an existing gear box. In some embodiments, the cylinder-nozzle assembly is designed to operate as a stand-alone unit to fit into an airsoft gun or other similar device or system.

FIGS. 3-7 illustrate one example embodiment of a cylinder-nozzle assembly according to the present general inventive concept. As shown in the perspective view in FIG. 3, and in the exploded view of the same embodiment in FIG. 4, the assembly 400 includes a frame body 410, a piston 510 with nozzle 515 and piston base 520, and a solenoid 610. In the illustrated example embodiment, as shown in the cross-sectional view in FIG. 6, a substantial portion of the piston 510 fits within the cylinder frame body 410 and moves within the cylinder frame body 410. The piston 510 includes a nozzle 515 (which defines a central air channel 530) and a piston base 520. As shown in the exploded view of FIG. 4 and in the cross-sectional views in FIGS. 6 and 7, a baffle member 540 fits over the piston base 520; the piston base 520 moves within the volume enclosed by the baffle member 540, and the baffle member 540 includes an aperture permitting through-passage by the nozzle 515. In some embodiments, the baffle member 540 includes one or more air slits 542 proximate the aperture and the nozzle 515.

Figure 6:
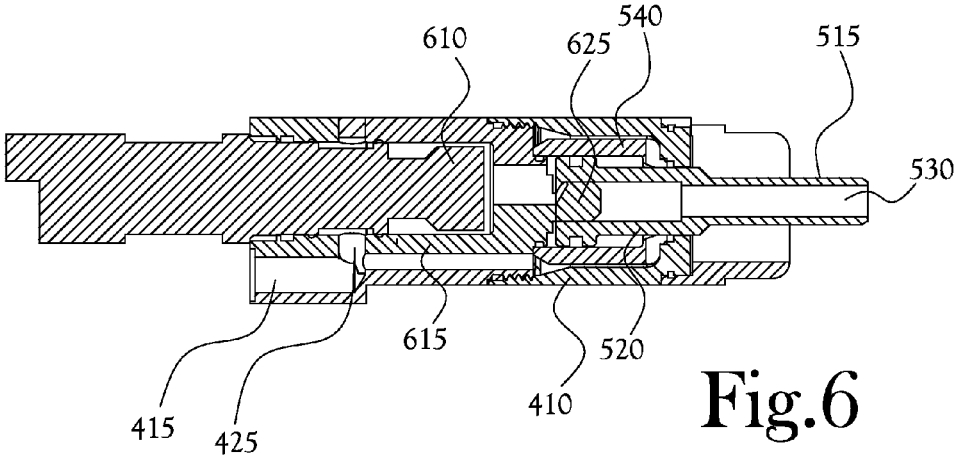
FIG. 6 is a section view of the example embodiment cylinder-nozzle assembly shown in FIGS. 3-5, showing piston and nozzle in the "back" position.
Figure 7:
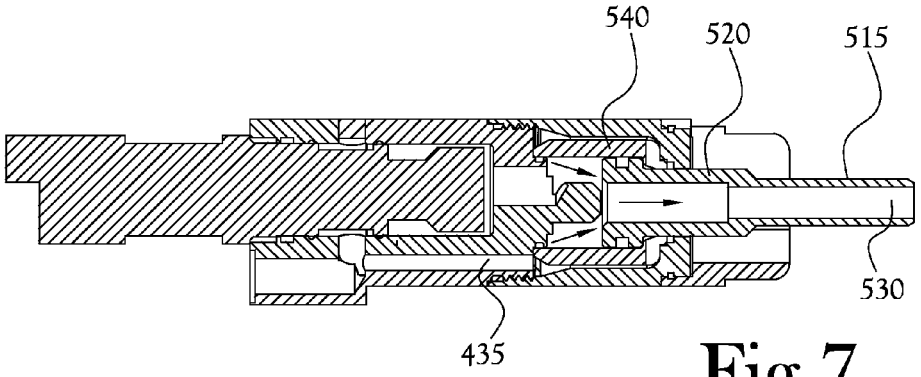
FIG. 7 is a second section view of the example embodiment cylinder-nozzle assembly shown in FIGS. 3-6, showing piston and nozzle in the "forward" position.

The cross-sectional view of FIG. 6 shows the cylinder-nozzle assembly 400 with the piston 510 in a "back" or rest position. In the back position, the piston base 520 sits within the baffle member 540 and the cylinder frame body 410 positioned towards the solenoid 610. The piston base 520 fits closely (but generally not in an air-tight fit) against and partially wraps around a central head member 625 of the solenoid 610.

To move the piston 510, high pressure air enters the assembly through an air input channel to a HPA compartment 415. From the HPA compartment 415, air passes through a solenoid input channel 425 into the solenoid 610. Within the solenoid 610 is a valve, which is capable of switching between a closed state and an open state. When a trigger mechanism of the airsoft gun activates the solenoid 610, the valve within the solenoid 610 switches into its open state, allowing the passage of air from the input channel through the solenoid 610 and into an antepiston compartment defined by the cylinder frame body 110 and proximate to both the central head member 625 and to the piston base 520. As air flows into the antepiston compartment, the air pushes on a primary piston head surface. Air pressure on the primary piston head surface pushes the piston base 520 forward within the cylinder frame body 410 and baffle member 540, until the piston 510 is in a "forward" position, illustrated in the cross-sectional view in FIG. 7. Once the piston 510 is in the forward position, air from the solenoid 610 passed into the antepiston compartment is free to travel through the open space between the piston base 520 and the central head member 325; from there the air passes through the central air channel 530 defined by the nozzle 515.

With the piston 510 in the forward position, the valve within the solenoid 610 closes, and high pressure air being fed into the HPA compartment 415, instead of flowing through the solenoid 610, flows through a secondary air line 435, which feeds the air into a forward air compartment within the cylinder frame body 410. The air in the forward air compartment exerts pressure on a secondary piston head surface, and that pressure drives the piston 510 to return to the back position shown in FIG. 6. In some example embodiments, the air slits 542 in the baffle member 540 permit the passage of air from the secondary air line to the secondary piston head surface. In some embodiments, the primary piston head surface and the secondary piston head surface are opposing surfaces of one piston member. In some embodiments, the two piston surfaces are opposite sides of the same piston, with the center diameter of the two sides differing—thereby leading to a difference in the surface area of the two piston surfaces.

Figure 8:
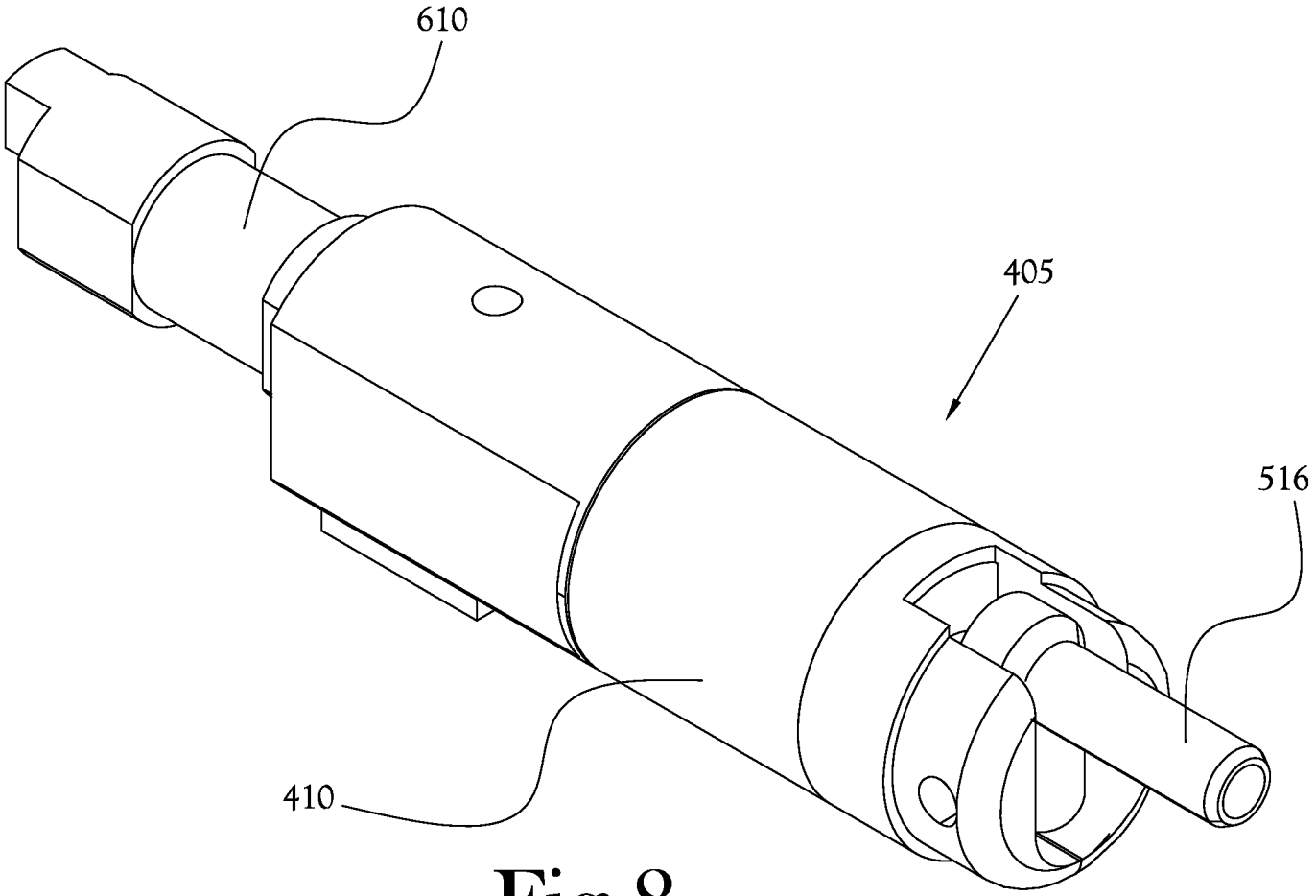
FIG. 8 is a perspective view of another cylinder-nozzle assembly according to another example embodiment of the present general inventive concept, showing a cylinder-nozzle assembly with an off-set nozzle.

In the example embodiments illustrated thus far, the nozzle is substantially centered with respect to the cylinder frame body. However, other configurations are contemplated by the present general inventive concept. For example, FIG. 8 shows a perspective view of a cylinder-nozzle assembly 405 with an off-set nozzle 516. Other variations and configurations will be apparent to those of skill in the art and are also within the scope of the present general inventive concept.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A high pressure cylinder for use in a gun, comprising:

a cylinder frame body;

a piston having a nozzle and a piston base portion, said piston defining a central air channel through the piston base portion and nozzle, said piston configured to move within said cylinder frame body along an axis, said piston base portion including a first piston head surface and a second piston head surface, said piston being configured to move between a forward position and a back position;

a solenoid valve configured to direct a fluid to said piston base portion such that fluid pressure on said first piston head surface moves said piston from the back position to the forward position;

an auxiliary fluid line configured to direct fluid against said second piston head surface such that fluid pressure on said second piston head surface moves said piston from the forward position to the back position; and a baffle member interposed between said piston base portion and said cylinder frame body.

2. The high pressure cylinder for use in a gun of claim 1 wherein said baffle member includes air slits configured to pass air from a secondary air line to said second piston head surface when said piston is in the forward position.

3. The high pressure cylinder for use in a gun of claim 1 wherein said first piston head surface and said second piston head surface are opposing surfaces of one piston member.

4. A high pressure cylinder for use in a gun, comprising:

a cylinder frame body;

a piston having a nozzle and a piston base portion, said piston moving within said cylinder frame body along an axis, said piston base portion including a first piston head surface and a second piston head surface, said piston configured to move between a forward position and a back position, and said piston defining an air channel entering said piston base portion and exiting through said nozzle;

a solenoid valve configured to direct a fluid to said piston base portion such that fluid pressure on said first piston head surface moves said piston from the back position to the forward position to open said air channel; and an auxiliary fluid line configured to direct fluid against said second piston head surface such that fluid pressure on said second piston head surface moves said piston from the forward position to the back position to close said air channel; and a baffle member interposed between said piston base portion and said cylinder frame body.

5. The high pressure cylinder of claim 4, wherein said air channel has a first opening in said first piston head surface, and a second opening in said nozzle.

6. The high pressure cylinder of claim 5, further comprising a central head member configured between said solenoid valve and said piston, wherein said first opening in said first piston head surface is configured to receive said central head member to close said air channel when said piston is proximate said back position.

7. The high pressure cylinder of claim 6, wherein said central head member is configured to close said air channel until said piston has moved a predetermined distance forward from said back position.

8. The high pressure cylinder of claim 7, wherein said piston is configured such that upon moving said predetermined distance forward from said back position, said first opening is not blocked by said central head member such that gas from said solenoid valve moves through said air channel.

9. The high pressure cylinder of claim 4, wherein fluid from the said solenoid valve is dispelled through said air channel when said piston moves proximate said forward position.

10. The high pressure cylinder of claim 4, wherein said baffle member includes air slits permitting passage of air from a secondary air line to said second piston head surface when said piston is in the forward position.

* * * * *